United States Patent [19]

Caetani et al.

[11] 4,339,253

[45] Jul. 13, 1982

[54] METHOD OF AND SYSTEM FOR LIQUEFYING A GAS WITH LOW BOILING TEMPERATURE

[75] Inventors: Enzo Caetani, Nanterre; Henri Paradowski, Cergy Pontoise, both of France

[73] Assignee: Compagnie Francaise d'Etudes et de Construction "Technip", Paris, France

[21] Appl. No.: 214,698

[22] Filed: Dec. 9, 1980

[30] Foreign Application Priority Data

Dec. 12, 1979 [FR] France ..... 7930489

[51] Int. Cl.[3] ..... F25J 1/02

[52] U.S. Cl. ..... 62/40; 62/335; 62/9; 62/114

[58] Field of Search ..... 62/9, 10, 114, 40, 335

[56] References Cited

U.S. PATENT DOCUMENTS 3,418,819 12/1968 Grunberg et al. ..... 62/40

3,964,891 6/1976 Krieger ..... 62/9

FOREIGN PATENT DOCUMENTS 2198105 8/1973 France .

2020408 5/1979 United Kingdom .

*Primary Examiner*—Norman Yudkoff

*Attorney, Agent, or Firm*—Kenyon & Kenyon

[57] ABSTRACT

A process of and apparatus for liquefying a dry gas with low boiling point in a first circuit through heat exchange with a main refrigerating fluid in a second circuit itself pre-cooled to its at least partial liquefaction through heat exchange with an auxiliary refrigerating fluid in a third circuit, wherein, for a same amount of treated products, the required total compression input power for the refrigerating fluids is reduced by performing in said third circuit an intermediate condensation between the two last compression stages followed by a phase separation, the gaseous phase being compressed to a high pressure in the last compression stage whereas the liquid phase is compressed to a high pressure by a pump and recycled to a cryogenic heat exchanger for cooling the gas initially in the moist state thereby at least partially drying same.

13 Claims, 5 Drawing Figures

Figure 1:
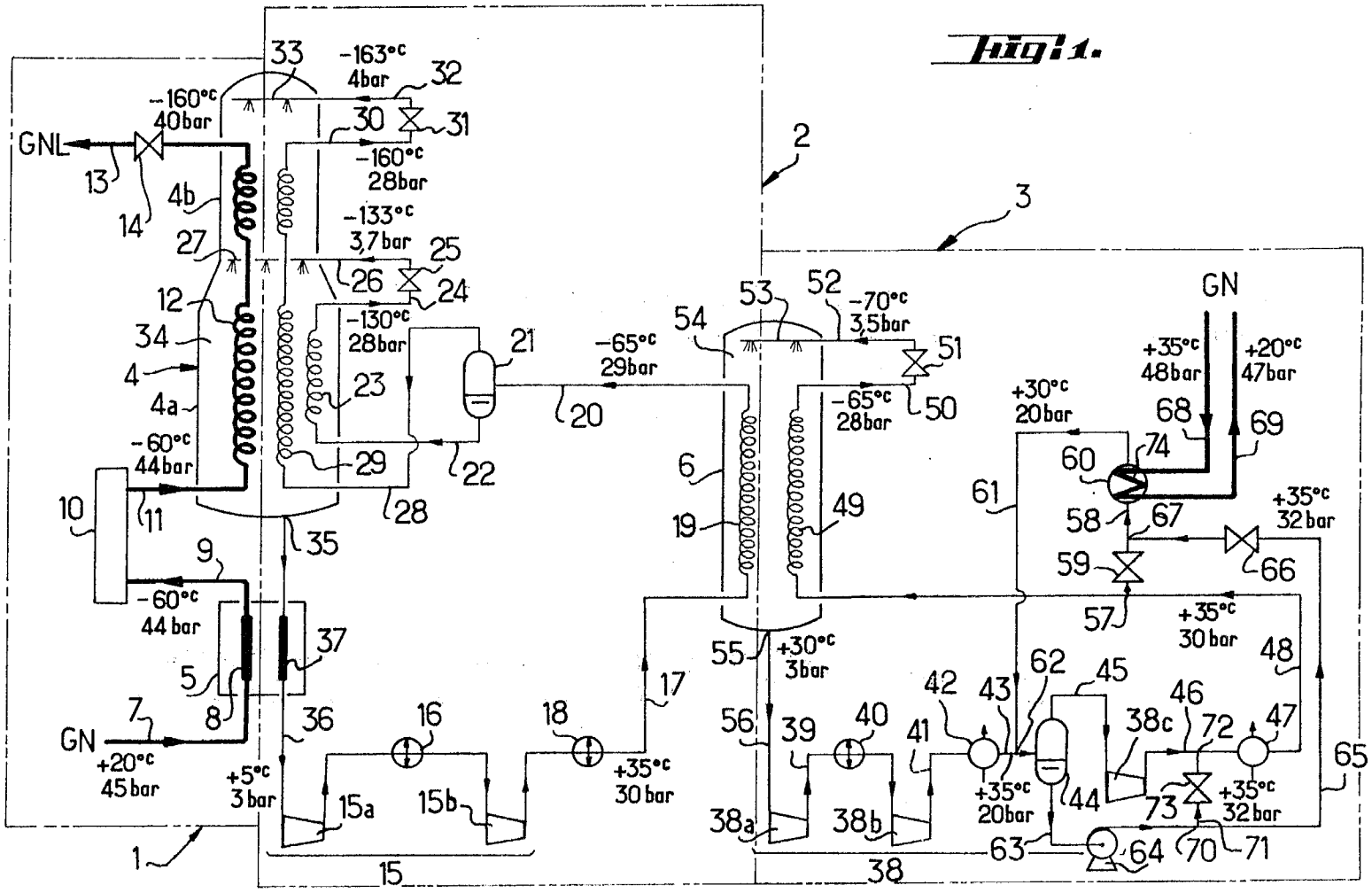

GN
GNL
+20°c 47bar
+35°c 48bar
+35°c 32bar
+35°c 30bar
+35°c 20bar
+35°c 30bar
+5°c 3bar
+20°c 45bar
-15°c 10bar
-10°c 29bar
-65°c 28bar
-70°c 3bar
-65°c 29bar
+30°c 9bar
-15°c 2,5bar
-163°c 4bar
-160°c 28bar
-133°c 3,7bar
-130°c 28bar
-160°c 40bar
-60°c 44bar
-60°c 44bar GN
GNL
+20°c 47bar
+35°c 48bar
+20°c 45bar
+35°c 32bar
+35°c 30bar
+30°c 20bar
+35°c 20bar
-15°c 44,5bar
-15°c 29bar
-20°c 10bar
-65°c 10bar
-65°c 28bar
-70°c 36bar
-65°c 29bar
+30°c 9bar
+30°c 25bar
-163°c 4bar
-160°c 28bar
-133°c 37bar
-130°c 28bar
-160°c 40bar
-60°c 44bar
-25°c 3bar GN
GN
GNL
+20°c 47bar
+35°c 48bar
+20°c 46bar
+35°c 32bar
+35°c 30bar
+35°c 32bar
+35°c 32bar
+30°c 20bar
+35°c 20bar
+30°c 9bar
-20°c 10bar
-15°c 29bar
-70°c 3bar
-65°c 28bar
-10°c 29bar
-15°c 10bar
-10°c 29bar
-65°c 29bar
-15°c 2,5bar
+35°c 30bar
-15°c 45bar
-163°c 4bar
-160°c 28bar
-133°c 37bar
-130°c 28bar
-160°c 40bar
-60°c 44bar
-60°c 44bar
-25°c 3bar

METHOD OF AND SYSTEM FOR LIQUEFYING A GAS WITH LOW BOILING TEMPERATURE

The present invention relates generally to an improvement to a method of and a system for refrigerating a fluid to be cooled down to a low temperature and in particular for liquefying a natural or synthetic gas having a low boiling temperature such for instance as a gas rich in methane. More particularly the invention is directed to and has essentially for its subject matter a method of saving energy and possibly initial capital costs in such a process as well as an apparatus for carrying out the latter. The invention aims also at the various applications and uses resulting from putting into practice of the method or process and/or of said apparatus as well as the devices, assemblies or units, arrangements, equipment, plants and installations fitted with such apparatus.

There are known methods of and systems for refrigerating fluids to be cooled and in particular for liquefying gases at low temperature, wherein it is possible in particular by passing through suitable heat exchangers to achieve the condensation of the gas at high pressure and low temperature and then the sub-cooling at high pressure of the liquefied gas and thereafter the expansion thereof while continuously flowing through an expansion member so as to eventually collect or recover the liquefied gas for instance in a low pressure storage tank or like vessel. It is also known in the presently known state of prior art to cool and liquefy at least one relatively dry gas having a low boiling point through heat exchange with at least one part of a so-called main or light refrigerating fluid previously cooled down to its at least partial liquefaction through heat exchange with another so-called auxiliary or heavy refrigerating fluid, these refrigerating fluids being part of an incorporated cold-generating cascade of several refrigerating fluids comprising at least said two aforesaid fluids. Each refrigerating fluid consists advantageously of a mixture of several component substances with preferably respective decreasing volatilities, evolving according to a closed-loop cooling cycle while successively undergoing therein the following steps and physical phenomena: at least one compression in the gaseous state from a low pressure to a higher pressure, at least one preliminary cooling possibly together with an at least partial condensation at said higher pressure through heat exchange with a cooling medium for instance of outer origin such as for instance water or air, at least one self-refrigeration with full liquefaction and then sub-cooling and thereafter expansion down to said low pressure through subsequent heat exchange (and attendant resulting vaporization) in countercurrent relation to itself before its expansion and to the other refrigerating fluid or to said gas for at least partial liquefaction of this latter fluid or gas, the thus reheated low pressure vapor of said refrigerating fluid being eventually recycled and recompressed. This known process obviously consumes input energy in view of the total power required for carrying out the various compressions of the various cooperating fluids present.

A main object of the invention is therefore to improve these known processes in particular so as to decrease, for a same amount of products treated, the required total input power taken by the compressions of at least the refrigerating fluids thereby cutting down the process costs through reduction of the energy expenditures as well as the power hence the purchase price of the compressors. For this purpose the invention in particular provides a method of saving or sparing energy and possibly initial capital cost in a process in particular of liquefying a relatively dry gas having a low boiling point, said method being characterized in that it consists in performing the compression of at least said auxiliary refrigerating fluid, adapted to cool and to at least partially liquefy said main refrigerating fluid, in several separate successive compressions of gradually increasing amounts and eventually a total compression of said auxiliary refrigerating fluid at different pressures, respectively, including at least one intermediate and at least one high pressure, at least the last but one compression being followed by said at least partial condensation, and then subjecting several distinct portions of said high pressure auxiliary refrigerating fluid to respective expansions at least down to an intermediate pressure and to said low pressure, followed each one by a vaporization at least in major part at the corresponding expanded pressure; the portion to be expanded to and which is at least partially vaporized at said low pressure as well possibly as at least one or each other portion to be expanded to and at least partially vaporized at a corresponding intermediate pressure being each one sub-cooled in the liquid state before its successive expansion and vaporization through heat exchange in counter-current relationship with at least one part of itself which is already previously expanded and then vaporized by said heat exchange, each portion thus vaporized at least in its major part then being recycled to be recompressed; the vaporization at the last intermediate pressure being effected in particular through heat exchange with said gas initially in the damp state to cool same thereby performing its relative drying through at least partial condensation of its moisture content, whereas each aforesaid portion, expanded to and then vaporized at another lower pressure, is also in heat exchange in counter-current relationship with said main refrigerating fluid for cooling and/or condensing at least partially same.

Thus in contrast to a certain known state of prior art using in particular two cycles of respectively light or main and heavy or auxiliary cold-generating fluids consisting of a plurality of components and wherein the heavy or auxiliary cold-producing fluid is vaporized at one single pressure and condensed at one single pressure, the fact of using according to the invention in the auxiliary refrigerating cycle of multiple-component heavy refrigerating fluid, an intermediate condensation and expansions to and vaporizations at several pressure levels makes it possible to decrease the total compression input power required in these refrigerating cycles of light and heavy cold-producing fluids, respectively, and therefore to cut down the cost of treatment for a same amount of gas process, thereby bringing about a significant progress or substantial technical improvement. As a general rule said auxiliary refrigerating fluid, at least partially condensed at said high pressure, is successively liquefied and then sub-cooled and thereafter expanded down to said low pressure through subsequent heat exchange (and resulting attendant vaporization) in counter-current relationship with itself before its expansion and with said main refrigerating fluid.

According to another characterizing feature of the invention the following operating steps are carried out on the auxiliary refrigerating fluid or on the gas to be liquefied:

performing said last but one compression on one portion of said auxiliary refrigerating fluid;

separation of respective gaseous and liquid phases of the total flow rate of the at least partially condensed auxiliary refrigerating fluid at the last intermediate pressure;

performing the last compression in two attendant separate compressions of said gaseous and liquid phases, respectively, up to said high pressure;

combining the high pressure gaseous phase and at least the major part of the high pressure liquid phase into a first partial flux in the mixed condition;

condensing at least to a large extent said first partial flux through heat exchange with a cooling medium preferably of outer origin such in particular as water or air;

taking one portion of said first partial flux at least one part of which undergoes full liquefaction, a subcooling and an expansion to said low pressure and then said heat exchange (with resulting attendant vaporization) in counter-current relationship with itself before expansion and with said main refrigerating fluid and thereafter recompression of the low pressure vapor up to a higher pressure;

attendant separate expansions of the other portion of said first partial flux and of the remaining part of said high pressure liquid phase down to said last intermediate pressure;

combining said other expanded vaporized portion and said remaining expanded part of said liquid phase into a second partial flux in the mixed condition and then reheating and vaporizing same to a large extent through said heat exchange with said gas;

returning and combining said second partial flux vaporized to a large extent with said first-named portion of said first partial flux at least partially condensed at said last intermediate pressure before said phase separation.

According to this arrangement setting forth the basic idea and the fundamental concept of general application of the invention, the auxiliary refrigerating fluid, having undergone a condensation at an intermediate pressure before being compressed to the high pressure, is expanded to and then vaporized at at least two different pressures which are said low pressure and at least said last intermediate pressure, respectively. Moreover the gas to be liquefied, which is initially in the relatively moist state, thus undergoes a previous drying at least to a large extent before being subjected independently of the method involved to a relatively full drying step before the cooling and condensation treatment through heat exchange in particular with the main refrigerating fluid.

According to still another characterizing feature of the invention at least one part of said first-named portion of said first high pressure partial flux is split after its full liquefaction and its sub-cooling into at least two fractions which then are separately expanded to and vaporized in parallel at said low pressure and at a mean or average intermediate pressure, respectively, which is lower than said last intermediate pressure, and fractions thus expanded being vaporized through heat exchange in counter-current relationship with themselves before expansion and with said main refrigerating fluid whereas said low pressure vapor after successive compression and preliminary cooling at said mean pressure is combined with said mean pressure vapor to thereby restore said first partial flux which is then recompressed to a higher intermediate pressure.

Thus according to this arrangement said auxiliary rerrigerating fluid initially in the high pressure liquid state is expanded to and vaporized here at three different pressures which are the low pressure, a first intermediate or mean pressure and a second or last intermediate pressure, respectively.

According to still a further characterizing feature of the invention, the gas to be liquefied in the relatively dry condition is pre-cooled by means of a heat exchange with said auxiliary refrigerating fluid. According to another characterizing feature of the invention, this pre-cooling step is performed by the fact that another part of said first-named portion of said first high pressure partial flux is successively fully liquefied and then sub-cooled and thereafter axpanded to and vaporized at said mean pressure, said other part thus expanded being vaporized through heat exchange in counter-current relationship with itself before expansion and with said relatively dry gas for pre-cooling the latter, the mean pressure vapors, originating from said corresponding fraction and from said other part, respectively, being then combined with said preliminarily cooled mean pressure vapor and thereafter recompressed together to said higher intermediate pressure.

According to another characterizing feature of the invention the at least partial liquefaction of said main refrigerating fluid takes place in two successive stages of increasing cooling and at least one part of said first-named portion of said first partial flux is successively liquefied fully and sub-cooled and then divided into two fractions the first one of which is expanded down to a mean intermediate pressure for subsequent heat exchange (and resulting attendant vaporization) in counter-current relationship with said portion before expansion and to said main refrigerating fluid for cooling the latter in a first step or stage whereas the second fraction is additionally sub-cooled and then expanded down to said low pressure for subsequent heat exchange (and resulting attendant vaporization) in counter-current relationship with itself before expansion and with said main refrigerating fluid already cooled previously for further cooling the latter in a second stage or step, the vapor at said low pressure being recycled to be recompressed to said mean pressure and then, after preliminary cooling through heat exchange with a cooling medium preferably of outer origin, combined with the mean pressure vapor of said first fraction before recompression to said last intermediate pressure.

According to still a further characterizing feature of the invention said mean pressure vapors originating respectively from said first fraction of one part of the first-named portion of said first partial flux on the one hand and from the other part of said portion on the other hand are combined together before recompression to said last intermediate pressure.

The invention is also directed to an apparatus for carrying out said method, of the kind comprising at least the following circuits: on the one hand, an in particular open circuit of gas to be liquefied; on the other hand, a closed circuit of main refrigerating fluid in heat exchanging relationship with said circuit of gas by means of cryogenic liquefaction, sub-cooling and pre-cooling heat exchangers, respectively, and which is part of an incorporated cold-generating cascade of at least two main and auxiliary refrigerating fluids, respectively; and at last a closed circuit of auxiliary refrigerating fluid in heat exchanging relationship with said circuit of main refrigerating fluid by means of at least one cryogenic heat exchanger for pre-cooling and at least partially liquefying said main refrigerating fluid. This circuit of auxiliary refrigerating fluid includes at least the following elements: at least one gaseous fluid compressor, a condensing cooler operating with a coolant preferably of outer origin, a flow passage-way for total liquefaction and sub-cooling extending through said pre-cooling heat exchanger and extending generally in the same direction as the flow passage-way for the main refrigerating fluid in said heat exchanger, a first expansion member at the downstream end of said flow passage-way for full liquefaction and sub-cooling, which member is connected to a vaporization passage-way extending through said pre-cooling heat exchanger to lead to the low pressure suction side of said compressor.

This apparatus is characterized according to the invention in that the outlet of said condensing cooler is connected to the inlet of a phase separator the vapor collecting space of which is connected to the suction side of another compressor the delivery side of which is connected to the inlet of another condensing cooler operating with a for instance outer coolant whereas the liquid collecting space of said separator is connected to the suction side of an accelerating and circulating pump the discharge side of which is connected in part to the inlet of said other condensing cooler and in part to a second expansion member; the outlet of said other condensing cooler being connected on the one hand to the inlet of said passage-way for full liquefaction and sub-cooling and on the other hand to a third expansion member; the outlets of said second and third expansion members being connected to the inlet of said phase separator through a cooler for said gas to be liquefied which is initially in a relatively moist or damp state.

Such an apparatus is generally of the kind having said circuit for auxiliary refrigerating fluid including at least two compressors connected in series through an intermediate or inter-stage cooler operating with a preferably outer cooling medium, wherein the suction side of said first compressor is connected to said vaporization passage-way and the delivery side of the second compressor is connected to the inlet of said first-named condensing cooler. According to another characterizing feature of the invention the downstream end of said passage-way for full liquefaction and sub-cooling is also connected in parallel relationship through another expansion member to another vaporization passage-way also extending through said pre-cooling heat exchanger, the respective downstream ends of both vaporization passage-ways being connected to the suction sides of both aforesaid compressors, respectively.

According to still a further characterizing feature of the invention said apparatus comprises at least one heat exchanger for pre-cooling the relatively dry gas to be liquefied, through which are extending a passage-way for said gas, a flow passage-way for total liquefaction and sub-cooling of said auxiliary refrigerating fluid the upstream end of which is branched off the duct connecting the outlet of said other condensing cooler to the inlet of said heat exchanger for pre-cooling the main refrigerating fluid whereas its downstream end is connected to the inlet of a fourth expansion member; a vaporization passage-way extending also through said pre-cooling heat exchanger and being connected at its upstream side to the outlet of said fourth expansion member and at its downstream side to the suction side of said second compressor.

According to another characterizing feature of the invention said pre-cooling heat exchanger consists of two heat exchangers or heat exchanging units through which are respectively extending two flow passage-ways for at least partial liquefaction of said main refrigerating fluid, which are connected in series and both aforesaid vaporization passage-ways for said auxiliary refrigerating fluid, the passage-way of the downstream heat exchanger unit being connected at its downstream end to the suction side of said first compressor and at its upstream end successively through the associated expansion member and an additional sub-cooling passage-way to the downstream end of the flow passage-way for full liquefaction and sub-cooling of the auxiliary refrigerating fluid in the upstream heat exchanger unit whereas the passage-way in the latter is connected to the suction side of said second compressor.

The passage-way for vaporization of said auxiliary refrigerating fluid, extending through the heat exchanger for pre-cooling and at least partially liquefying said main refrigerating fluid consists advantageously of the inside space of the casing or shell of said heat exchanger which contains and surrounds said flow passage-ways for the main and auxiliary refrigerating fluids, respectively, therein and the outlet of the expansion member associated with said passage-way is connected to an expanded fluid distribution device opening into said inside space preferably towards the upstream ends of said flow passage-ways, respectively. Thus the expanded auxiliary refrigerating fluid will flow in a direction opposite to the common direction of flow of said main and auxiliary refrigerating fluids while streaming about their respective confined flow passage-ways so as to further cool same, thereby keeping vaporizing the distributed auxiliary refrigerating fluid through heating thereof. According to still a further characterizing feature of the invention a similar configuration of the vaporization passage-way and of the distributing device is provided in any other aforesaid heat exchanger associated with one single aforesaid expansion member for the auxiliary refrigerating fluid, provided that the refrigerating fluid be not expanded down to one single and same pressure in a same heat exchanger. It is obvious that each aforesaid vaporization passage-way could also consist of a separate or individual confined flow passage-way.

Figure 2:
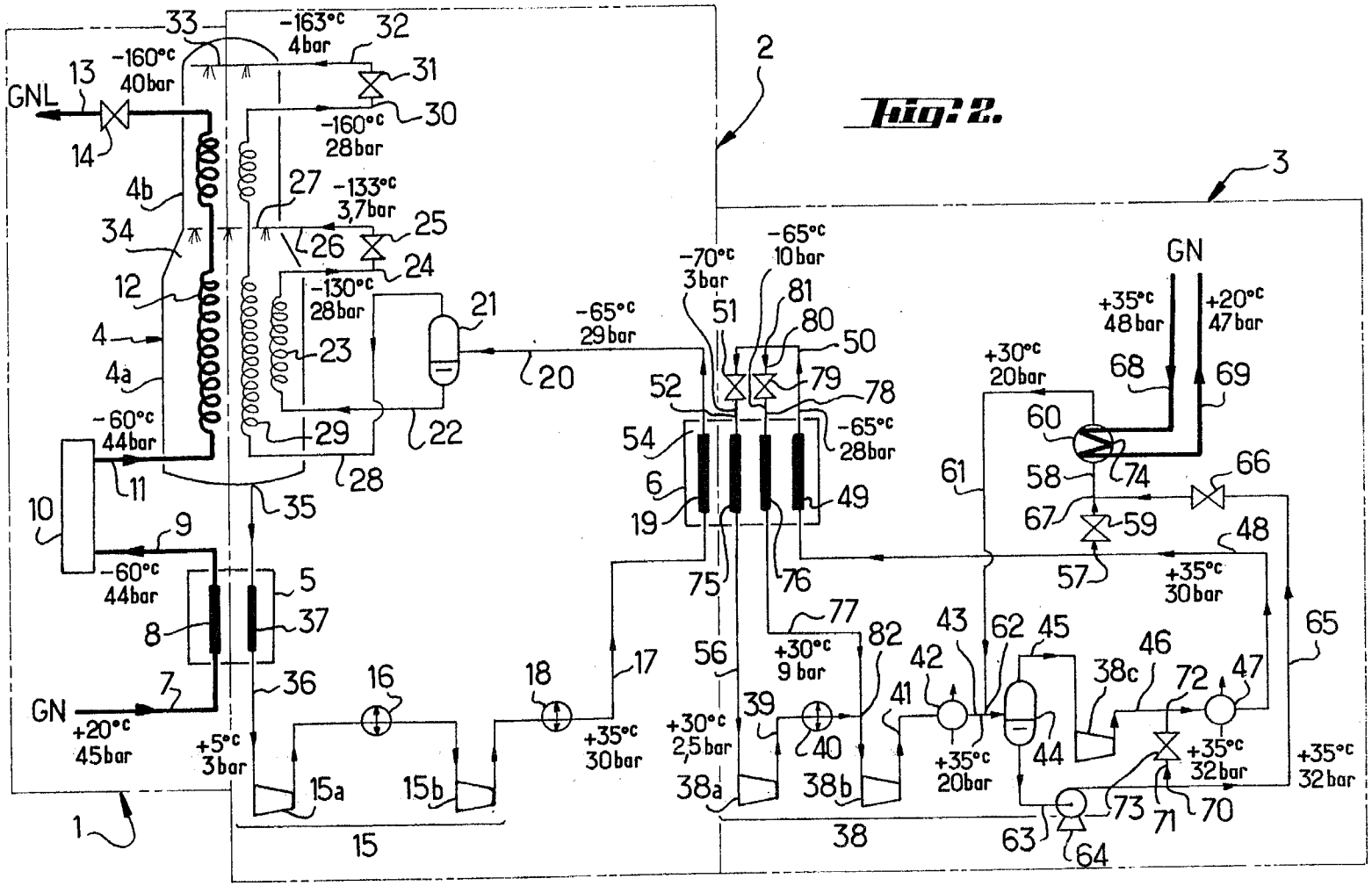
Figure 3:
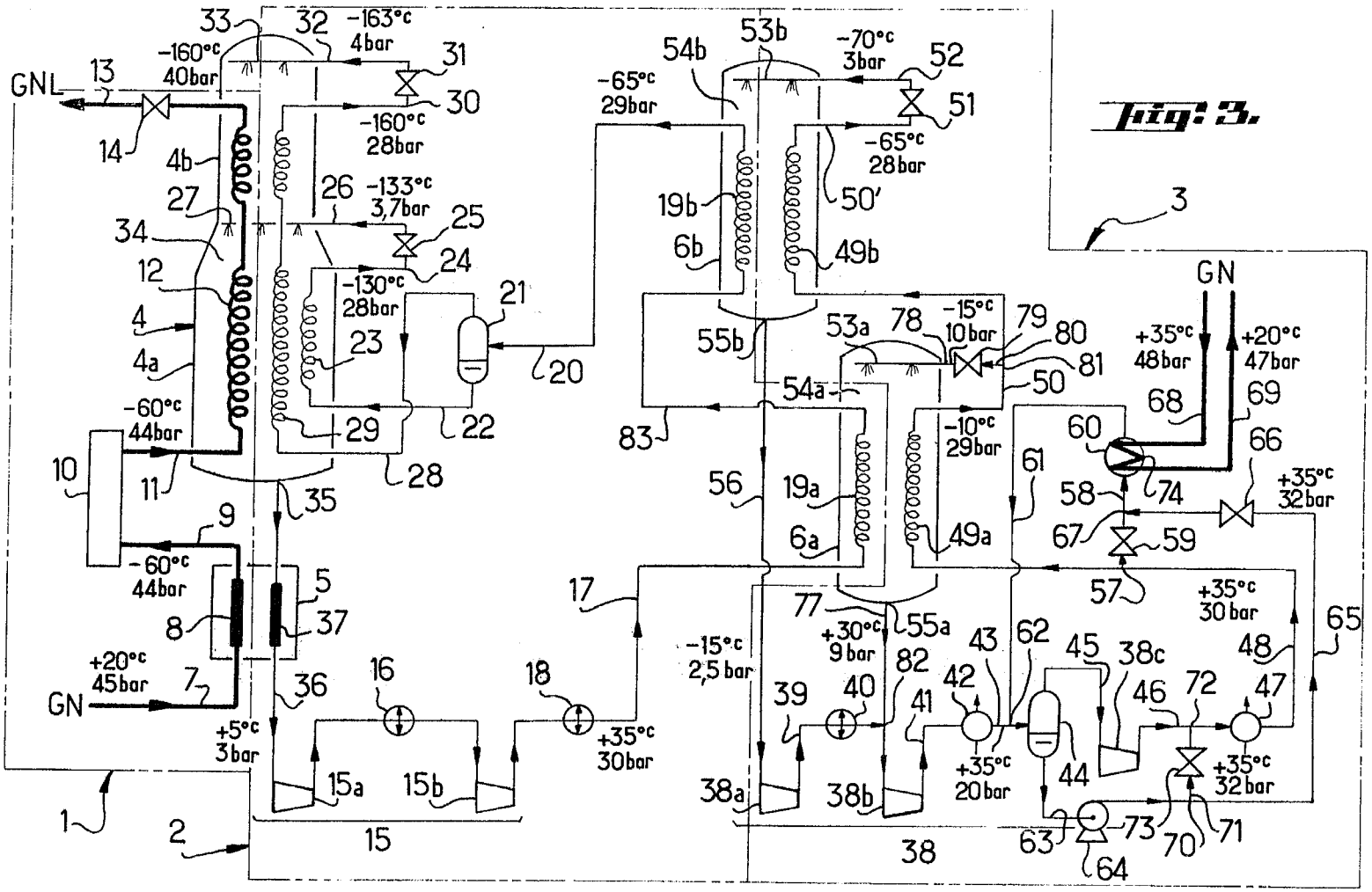
Figure 4:
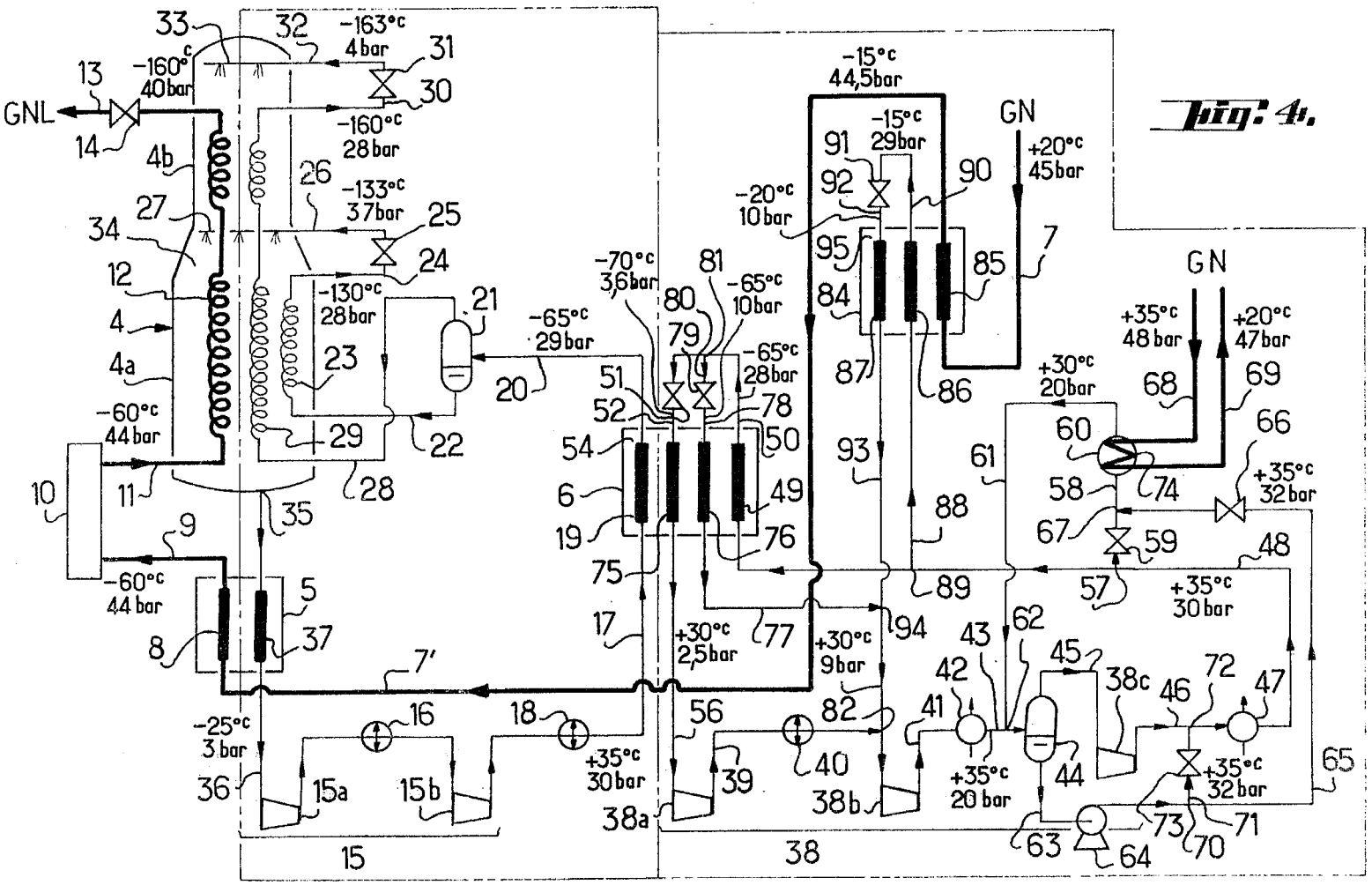
Figure 5:
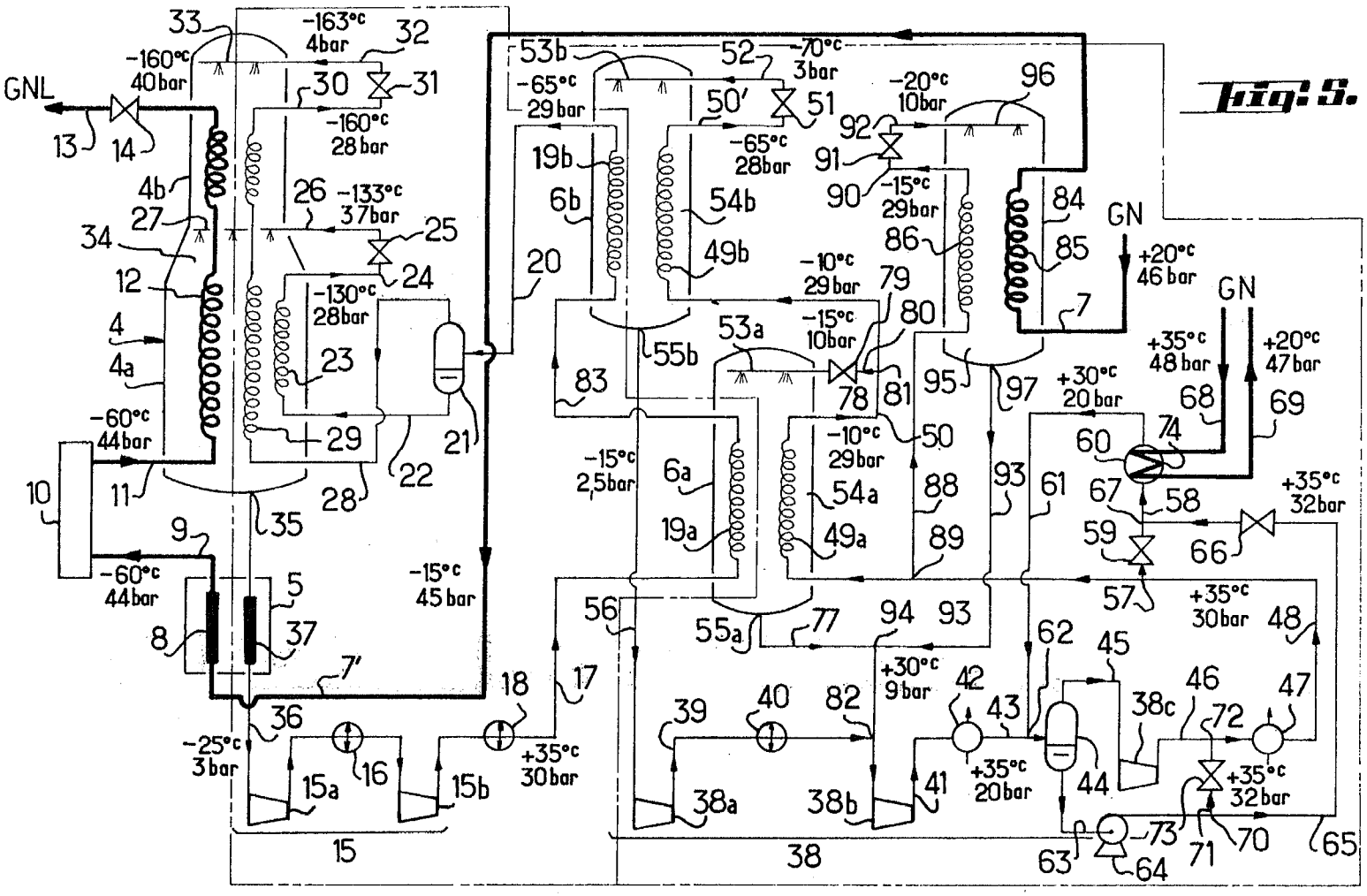

The invention will be better understood ind further objects, characterizing features, details and advantages thereof will appear more clearly as the following explanatory description proceeds with reference to the accompanying diagrammatic drawings given by way of non-limiting examples only illustrating various presently preferred specific embodiments of the invention and wherein:

FIG. 1 shows an embodiment of a system for liquefying a for instance natural gas with condensation of the auxiliary refrigerating fluid at two differing intermediate and high pressures, respectively, and with expansions to and vaporizations thereof at two differing intermediate and low pressures, respectively, as well as with cooling of the gas to be liquefied, which is initially in the moist or damp state, in particular for at least partially drying same;

FIG. 2 illustrates another embodiment of the system wherein the auxiliary refrigerating fluid is expanded to and vaporized at three different low, mean and intermediate pressures, respectively, the respective expansions to and vaporizations at the two first pressures being performed in confined flow passage-ways within the heat exchanger for precooling and at least partially liquefying the main refrigerating fluid;

FIG. 3 shows another embodiment of the system with three different expansion and vaporization pressures according to FIG. 2, wherein the main refrigerating fluid is cooled and at least partially liquefied in two successive steps effected within two distinct heat exchangers through corresponding heat exchanges with the auxiliary refrigerating fluid;

FIG. 4 illustrates a modification of the system according to FIG. 2 consisting in the addition of a heat exchanger for pre-cooling the gas to be liquefied in a relatively dry condition by the auxiliary refrigerating fluid expanded to and vaporized at said intermediate pressure, the vaporization passage-ways of the auxiliary refrigerating fluid in both heat exchangers consisting of individual or separate confined flow passage-ways; and FIG. 5 shows an alternative embodiment of the system according to FIG. 3 consisting in the addition of a heat exchanger for pre-cooling the gas to be liquefied in a relatively dry state whereas in each heat exchanger of the circuit for the auxiliary refrigerating fluid is performed the distribution of the auxiliary refrigerating fluid expanded directly into the inside space of the shell or casing of the heat exchanger involved, together with attendant vaporization in said space.

On the various Figures of the drawings the same reference numerals have been used to designate like or similar elements or parts and the numerical pressure values stated by way of example are expressing absolute pressures.

According to the examplary embodiment shown in FIG. 1, the open circuit of the for instance natural gas GN to be liquefied is generally denoted by the reference numeral 1 whereas the closed circuit of the main refrigerating fluid is generally designated by the reference numeral 2 and the closed circuit of the auxiliary refrigerating fluid is denoted by the reference numeral 3. Each circuit is symbolically defined or bounded and contained within a box or rectangular frame drawn in discontinuous chain-dotted lines and the path of travel of the gas to be liquefied has been shown by a continuous solid thicker line. The circuit of gas to be liquefied 1 and the circuit of main refrigerating fluid 2 are thermally combined together or interconnected through the agency of common cryogenic heat exchangers 4 and 5 for liquefying and sub-cooling the gas on the one hand and for preliminarily cooling the gas, respectively. The respective circuits of the main and auxiliary refrigerating fluids 2 and 3 are combined together through the agency of at least one common cryogenic heat exchanger 6 for pre-cooling and at least partially liquefying the main refrigerating fluid.

The open circuit 1 of gas to be liquefied comprises a feed or inlet pipe-line 7 leading to the preliminary cooling heat exchanger 5 and connected to at least one inner flow passage-way 8 of this heat exchanger the outlet of which is connected through a duct 9 to an optional gas treating apparatus 10 the outlet of which is connected through a duct 11 to the inlet of the heat exchanger 4. This heat exchanger consists of two successive heat exchanging units for liquefying the gas in the heat exchanger unit **4*a* and for sub-cooling the liquefied gas in the heat exchanger unit 4*b*, which heat exchanging units may either be distinct or separate or be combined together or grouped (as shown in the drawing) within a same common enclosure defined or bounded by a same shell or casing of the heat exchanging apparatus 4. Both units or sections 4*a* and 4*b*** are communicating with and connected in series to each other.

The duct 11 is thus connected to an inner flow passageway 12 extending successively through both heat exchanging units or sections **4*a* and 4*b* and the downstream end of which is connected at the outlet of the heat exchanger 4 to a pipe-line 13 for liquefied natural gas GNL through at least one expansion member 14** such as for instance an expansion valve.

The closed circuit 2 contains a main or light refrigerating fluid consisting of a mixture of a plurality of components at least the major part of which consists advantageously of hydrocarbons. The relative molar composition of this light refrigerating fluid may for instance be the following:

nitrogen $N_2$: 0% to 10%
methane $CH_4$: 30% to 60%
ethylene $C_2H_4$ or ethane $C_2H_6$: 30% to 60%
propylene $C_3H_6$, propane $C_3H_8$, butane $C_4H_{10}$ and less volatile hydrocarbons: 0% to 20%

This circuit 2 successively comprises in the direction of flow of the refrigerating fluid: at least one compressor 15 for the refrigerating fluid in the gaseous condition, having for instance two low pressure and high pressure stages **15*a* and 15*b* driven either each one separately by an individual prime mover or together jointly by a common prime mover while having then their respective shafts operatively coupled together mechanically. These two compressor stages 15*a* and 15*b* are connected in series through at least one intermediate or inter-stage cooler 16 the coolant of which is advantageously of outer origin and consists for instance of water or air. The outlet or delivery port of the high pressure compressor stage 15*b* is connected by a duct 17 through a cooling device 18 (the cooling medium of which is advantageously of outer origin such for instance as water or air) to the inlet of the heat exchanger 6 and more specifically to the upstream end of at least one inner flow passage-way 19 extending therein. At the outlet of the heat exchanger 6 the downstream end of the flow passage-way 19 is connected through a pipe-line 20 to at least one phase separator 21. The liquid collecting space of this phase separator is connected through a pipe-line 22 to the inlet of the heat exchanger 4 and more specifically to the upstream end of at least one flow passage-way 23 extending inside of the heat exchanging unit or section 4*a* of the heat exchanger 4 in a direction at least approximately parallel to the inner flow passage-way 12. The downstream end of the inner flow passage-way 23 is connected at the outlet of the heat exchanging section 4*a* through a duct 24 to the inlet of an expansion member 25 such as a valve or the like the outlet of which is connected through a duct 26 to a for instance jet-producing spray distribution member or the like 27 communicating with the inside space of the casing or shell of the heat exchanger 4 or placed within the latter while opening directly into this space at the corresponding end of the heat exchanging unit 4*a* towards the downstream end of the flow passage-way 23 and being oriented towards the opposite end of said heat exchanging unit 4*a***; thus, the fluid distributed into said space will flow while keeping vaporizing in said opposite direction about the confined flow passage-ways contained within said space while streaming thereabout in direct contact therewith.

The vapor collecting space of the phase separator 21 is connected through a pipe-line 28 to the inlet of the heat exchanging section 4a and more specifically to the upstream and of at least another inner flow passage-way 29 extending in substantially parallel relation to the flow passage-ways 12 and 23 successively in both heat exchanging units 4a and 4b. The downstream end of this flow passage-way 29 is connected at the outlet of the heat exchanging unit 4b through a duct 30 to the inlet of an expansion member such as a valve or the like 31 the outlet of which is connected through a duct 32 to a for instance jet-generating spray distribution member or the like communicating with the common inside space of the casing or shell of the heat exchanger 4 while being in particular positioned therein to open directly into said space towards the corresponding end of said heat exchanger and towards the respective downstream ends of the flow passage-ways 12 and 29 while being thus pointing towards the opposite end of the heat exchanger in a direction opposite to the respective directions of flow of fluids in these two flow passage-ways; thus the distributed fluid will flow while keeping vaporizing in said direction about the inner flow passage-ways while streaming thereabout in direct contact therewith. The downstream end of said common inside space 34 within the enclosure defined or bounded by the casing or shell of the heat exchanger 4, towards the respective upstream ends of said flow passage-ways 12, 23 and 29, communicates through at least one outlet port 37 of said shell with the low pressure suction side of the first compressor stage 15a by means of a pipe-line 36 through the agency of at least one vapor passage-way 37 extending through the cryogenic cooling heat exchanger 5 while extending in at least approximate parallel relation to the direction of the gas flow passage-way 8.

The circuit 3 contains a so-called auxiliary or heavy refrigerating fluid consisting of a mixture preferably of hydrocarbons only having for instance the following relative molar composition:

methane $CH_4$: 0% to 15%
ethylene $C_2H_4$ or ethane $C_2H_6$: 30% to 65%
propylene $C_3H_6$ or propane $C_3H_8$: 10% to 60%
isobutane or normal butane and less volatile hydrocarbons: 0% to 30%

The closed circuit 3 of heavy or auxiliary refrigerating fluid successively comprises the following elements in the direction of flow of the fluid: a compressor set 38 for the gaseous fluid, consisting of at least two and for instance three stages or compressors 38a, 38b and 38c connected in series to each other and driven either separately by individual prime movers, respectively, or by at least one prime mover common to at least two compressors which are then directly operatively coupled mechanically to each other through their respective shafts. The outlet or delivery port of the first compressor 38a is connected to the inlet or suction port of the second compressor 38b by a duct 39 through a cooling device 40 operating with a coolant preferably of outer origin such for instance as water or air. The outlet or delivery port of the second compressor 38b is connected through a pipe-line 41 to the inlet of a condensing cooler 42 which is advantageously of the kind operating with a cooling medium of outer origin consisting for instance of water or air. The outlet of the condenser 42 is connected through a pipe-line 43 to a phase separator 44 the vapor phase collecting space of which is connected through a pipe-line 45 to the suction port of the last compressor 38c the outlet or discharge port of which is connected through a pipe-line 46 to the inlet of a condensing cooling device 47 which is advantageously of the kind operating with a coolant of outer origin consisting for instance of water or air. The outlet of the condenser 47 is connected through a duct 48 to the upstream end of at least one flow passage-way 49 extending in the heat exchanger 6 common to both circuits 2 and 3 while being at least approximately parallel to the direction of the flow passage-way 19. The downstream end of the flow passage-way 49 is connected through a duct 50 to the inlet of a continuous or permanent flux expansion member such as a valve or the like 51 located outside of the heat exchanger 6 and the outlet of which is connected through a duct 52 to a for instance jet-producing spray distribution system 53 or the like similar to the system 33 and communicating with the inside space 54 of the casing or shell of the heat exchanger 6 towards the corresponding end of the latter and towards the respective downstream ends of the flow passage-ways 19 and 49 while being oriented towards the latter so as to open directly into said space in order that the distributed fluid flow in said direction about the flow passage-ways 19 and 49 while streaming therabout in direct contact therewith. The opposite end of this inside space 54 communicates by an outlet port 55 through the shell of the heat exchanger 6 with a pipe-line 56 connecting it to the suction port of the first compressor 38a. At an intermediate point 57 of the delivery pipe-line 48 is connected a branch duct 58 connected through an expansion member such as a valve or the like 59 to the inlet of a cooling device 60 the outlet of which is connected through a duct 61 to an intermediate point 62 of the pipe-line 43 between the condenser 42 and the phase separator 44.

The liquid phase collecting space of the phase separator 44 is connected through a pipe-line 63 to the suction port of an accelerating and circulating pump 64 the delivery port of which is connected by a pipe-line 65 through a expansion member such as a valve or the like 66 to an intermediate branch point 67 of the duct 58 between the expansion valve 59 and the cooling device 60. This cooling device 60 is adapted to cool the moist natural gas entering the cooling device 60 through an inlet duct 68 and issuing therefrom through an outlet duct 69.

At an intermediate point 70 of the pipe-line 65 is connected a branch duct 71 connecting the pipe-line 65 to an intermediate point 72 of the duct 46 (between the compressor 38c and the condenser 47) through a valve 73.

The circuit 1 then operates as follows: the for instance natural gas to be liquefied GN in a relatively dry state, fed by the pipe-line 7 at a temperature for instance of about +20° C. and at an absolute pressure for instance of about 45 bars flows through the passage-way 8 of the heat exchanger 5 to be preliminarily cooled therein through heat exchange with the light or main refrigerating fluid circulating in the passage-way 37 of the same heat exchanger 35 in a direction opposite to the direction of flow of the gas in the passage-way 8. Upon leaving the heat exchanger 5 through the duct 9 the gas is then at a temperature for instance of about −60° C. and at an absolute pressure for instance of about 44 bars and it thereafter flows through the treating apparatus 10 to then reach through the duct 11 the inlet of the flow passage-way 12 in the successive heat exchanging units 4a and 4b to be liquefied fully and then sub-cooled, respectively, therein, through heat exchange with the main refrigerating fluid. When exiting from the heat exchanger 4 the liquefied gas is at a temperature for instance of about −160° C. and at an absolute pressure for instance of about 40 bars; it is then expanded in the expansion valve 14 and then transferred through the pipe-line 13 to the location of preservation or storage of liquefied natural gas GNL or to a station for treating or utilizing same.

The cycle 2 of the main refrigerating fluid operates as follows: the main refrigerating fluid is drawn in in the fully vaporized or gaseous state at a temperature for instance of about +5° C. and at a lower absolute pressure for instance of about 3 bars by the first compressor 15a wherefrom it is delivered at an intermediate pressure through the intermediate or inter-stage cooler 16 and then drawn in by the second compressor 15b which then discharges it still in the gaseous state at a high absolute pressure of about 30 bars through the after-cooler 18 wherefrom it issues preferably still in the gaseous state at a temperature for instance of about 35° C. It then enters the flow passage-way 19 of the heat exchanger 6 where the main refrigerating fluid is cooled through heat exchange with the auxiliary refrigerating fluid so as to become liquefied at least partially. The main refrigerating fluid thus at least partially condensed at a temperature for instance of about −65° C. and at an absolute pressure for instance of about 29 bars then leaves the heat exchanger 6 as a mixture of gaseous and liquid phases, respectively, which are then separated in the phase separator 21. The gaseous phase is carried through the duct 28 into that segment of the flow passage-way 29 which is located in the heat exchanging unit 4a of the heat exchanger 4 to be liquefied therein and thereafter this liquefied fraction is sub-cooled in that segment of the flow passage-way 29 which is placed in the heat exchanging unit 4b of the heat exchanger 4 wherefrom this sub-cooled fraction issues through the duct 30 at a temperature for instance of about −160° C. and at an absolute pressure for instance of about 28 bars to then flow through the expansion valve 31 to expand therein. This expansion has cooled this fraction down to a temperature for instance of about −160° C. thereby lowering its absolute pressure for instance to about 4 bars and then is expanded fraction is fed by the pipe-line 32 to the distributing device 33 wherein the expanded fraction is for instance sprayed into the vaporization passage-way 34 consisting of the space inside of the shell common to the heat exchanging units 4a and 4b. The main refrigerating fluid thus distributed flows in that inside space while streaming about the flow passage-ways 12, 23 and 29 so that it keeps vaporizing through direct contact therewith while flowing in counter-current relation to the fluids carried in these flow passage-ways, respectively.

The liquid phase of the main refrigerating fluid issuing from the phase separator 21 is fed by the pipe-line 22 to the flow passage-way 23 of the heat exchanging unit 4a of the heat exchanger 4 to be sub-cooled therein to a temperature for instance of about −130° C. and at an absolute pressure for instance of about 28 bars and it leaves the heat exchanging unit 4a through the duct 24 to thereafter flow through the valve 25 to be expanded therein. This expansion has thus cooled this fraction down to a temperature for instance of about −133° C. thereby lowering its pressure for instance to about 3.7 bars and then the expanded fluid is carried by the duct 26 to the distributing member 27 to be for instance sprayed therein into that portion of the common inner space 34 which is inside of the heat exchanging unit 4a. This distributed portion then flows in counter-current relationship, i.e. in a direction opposite to the direction of flow of the fluids in the respective flow passage-ways 12, 23 and 29 while streaming thereabout so as to keep vaporizing through direct contact therewith and its vapor mixes with that of the vaporized fraction of the refrigerating fluid issuing from the heat exchanging unit 4a of the heat exchanger 4 to then flow while streaming about said three flow passage-ways. This direct contact between the vaporized refrigerating fluids and said flow passage-ways results in a heat exchange therebetween thereby bringing about on the one hand the strong sub-cooling of the liquefied gas and of the liquefied refrigerating fluid circulating in the corresponding segments, respectively, of the flow passage-ways 12 and 29 located in the heat exchanging unit 4b and on the other hand the liquefaction of these fluids in the corresponding segments of the same flow passage-ways located in the heat exchanging unit 4a as well as the sub-cooling of the liquid refrigerating fluid circulating in the flow passage-way 23 of this same heat exchanging unit 4a.

The total vaporized main refrigerating fluid leaving the heat exchanger 4 through the outlet port 35 and the pipe-line 36 then flows through the heat exchanger 5 by means of the flow passage-way 37 while circulating therein in a direction opposite to the direction of flow of the natural gas in the flow passage-way 8 so as to cool the latter through heat exchange. The gaseous main refrigerating fluid exiting from the heat exchanger 5 for instance at a temperature of +5° C. and at an absolute pressure of 3 bars is then drawn in again by the first compressor 15a with a view to repeat the refrigerating cycle.

The operation of the cycle 3 of auxiliary refrigerating fluid is the following: the auxiliary refrigerating fluid is drawn in in the gaseous state for instance at a temperature of about +30° C. and at a low absolute pressure for instance of about 3 bars by the first compressor 38a which delivers it at a lower mean or intermediate pressure through the intermediate or inter-stage cooler 40 wherefrom it is drawn in still in the gaseous state by the second compressor 38b which discharges it at a higher intermediate pressure for instance of about 20 bars into the condenser 42 where the compressed auxiliary refrigerating fluid condenses at least partially into a mixture of gaseous and liquid phases, respectively, at a temperature for instance of about +35° C. Upon leaving the condenser 42 the auxiliary refrigerating fluid mixes with another fraction of itself vaporized to a large extent and then undergoes a phase separation in the separator 44. The gaseous phase is drawn in by the third compressor 38c to be delivered at a high absolute pressure for instance of about 30 bars into the pipe-line 46. The liquid phase is sucked by the accelerating pump 64 which raises its pressure to the high delivery pressure of the third compressor 38c and forwards or supplies this liquid phase compressed for instance to an absolute pressure of about 32 bars and at a temperature for instance of about +35° C. to the delivery pipe-line 65 where a major portion is diverted by the pipe-line 71 through the valve 73 and led to the delivery pipe-line 46 to mix with the gaseous fluid delivered by the compressor 38c whereas the other minor portion in the duct 65 is expanded in the liquid state (without any phase change) in the valve 66 to said higher intermediate pressure of 20 bars. The high pressure mixture of the gaseous and liquid phases, respectively, in the duct 46 downstream of the branch point 72 then enters the condenser 47 to be liquefied to a large extent therein. The fluid thus liquefied at least to a large extent issues from the condenser 47 through the duct 48 and is split at the branch point 57 into two parts, namely: one part flowing through the flow passage-way 49 in the heat exchanger 6 to be successively fully liquefied and then sub-cooled therein through heat exchange of at least one fraction of itself whereas the other part diverted by the branch duct 58 flows through the valve 59 to be expanded therein down to said higher intermediate pressure of about 20 bars thereby inducing its attendant partial vaporization. The liquid fluid sub-cooled in the flow passage-way 49 of the heat exchanger 6 leaves the latter through the duct 50 at a temperature for instance of about −65° C. and at an absolute pressure for instance of about 28 bars and flows through the valve 51 to be expanded therein. This expansion cools it down to a temperature for instance of about −70° C. thereby lowering its absolute pressure for instance to about 3.5 bars and then the expanded fluid reaches the distributing device 53 where it is for instance sprayed in jets into the inner space 54 of the casing or shell of the heat exchanger 6. The fluid thus distributed flows in the vaporization passage-way consisting of said inner space 54 in a direction opposite to the common direction of flow of the respective fluids in the flow passage-ways 19 and 49 while simultaneously streaming about these two flow passage-ways in direct contact therewith. Thus a heat exchange is induced between the fluids respectively carried in the flow passage-ways 19 and 49 on the one hand and the auxiliary refrigerating fluid sprayed into the inner space 54 on the other hand, which keeps vaporizing through attendant heating whereas the respective fluids in the flow passage-ways 19 and 49 are thus cooled thereby resulting on the one hand in the at least partial liquefaction of the main refrigerating fluid circulating in the flow passage-way 19 and on the other hand successively in the full liquefaction and then the sub-cooling of the auxiliary refrigerating fluid circulating in the flow passage-way 49. The auxiliary refrigerating fluid vaporized in the inner space 54 of the heat exchanger 6 is then discharged therefrom through the outlet port 55 at a temperature for instance of about +30° C. and at said low pressure for instance of about 3 bars to be fed through the pipe-line 56 to the suction side of the first compressor 38*a* in order to thus provide for the repetition of the refrigeration cycle 3.

The expanded liquid fraction of the auxiliary refrigerating fluid leaving the valve 66 joins or meets at the branch point 67 with the partially vaporized fraction issuing from the valve 59 thereby mixing with this latter fraction and then this mixture of gaseous and liquid phases, respectively, flows through the cooling device 60 wherein is then induced a heat exchange between the auxiliary refrigerating fluid on the one hand and the moist natural gas on the other hand flowing through this cooling device through the inner flow passage-way 74 while circulating therein in a direction opposite to the direction of flow of the auxiliary refrigerating fluid. The moist natural gas GN is fed to the cooling device 60 by the pipe-line 68 at a temperature for instance of about +35° C. and at an absolute pressure for instance of about 48 bars and is cooled by flowing therethrough while thereby undergoing therein an at least partial condensation of its moisture content and then leaves said device through the pipe-line 69 at a temperature for instance of about +20° C. and at an absolute pressure for instance of about 47 bars in a relatively dry state to be thereafter further dried and then carried to the inlet duct 7 of the circuit 1 (its pressure having been then lowered to 45 bars in view of the pressure losses sustained). In the cooling device 60 the auxiliary refrigerating fluid is reheated through said heat exchange with the moist natural gas while being thus partially vaporized and it leaves the cooling device 60 at a temperature for instance of about 30+° C. and at said higher intermediate pressure of 20 bars to join through the duct 61 at the branch point 62 the at least partially condensed fraction of auxiliary refrigerating fluid arriving through the duct 43 from the condenser 42 so that this mixture of gaseous and liquid phases, respectively, thus restored again undergoes the phase separation in the separator 44 with a view to repeat the refrigeration cycle 3.

It is important to point out that the recycling of the liquid part of the high pressure auxiliary refrigerating fluid by the accelerating pump 64 in the duct 65 makes it possible to avoid the formation and the precipitation of hydrates in the moist natural gas when flowing through the cooling device 60 owing to the fact that the temperature of the auxiliary refrigerating fluid is at least approximately maintained in spite of its expansion in the valve 59 through the supply at the branch point 67 of the liquid part arriving through the duct 65.

The heat exchangers 4 and 6 are for instance of the type consisting of nests, bundles or clusters of coiled tubes whereas the heat exchanger 5 is for instance of the plate construction type.

The system illustrated by FIG. 2 differs in particular from that shown on FIG. 1 by the fact that on the one hand the heat exchanger 6 is preferably of the plate construction type and that at the outlet of the expansion valve 51 the duct 52 is connected to a confined vaporization passage-way 75 of the heat exchanger 6 inserted between the ducts 52 and 56 and on the other hand that in the heat exchanger 6 is provided an additional confined vaporization passage-way 76 having its downstream end connected through a duct 77 to the suction port of the second compressor stage 38*b* and its upstream end connected through a duct 78 to the outlet of another expansion member such as a valve or the like 79 the inlet of which is branched off by a pipe-line 80 at an intermediate point 81 of the pipe-line 50 located between the valve 51 and the flow passage-way 49. At the outlet of the inter-stage or intermediate cooler 40 between the first and second compressors 38*a* and 38*b* the duct 39 is branched at an intermediate point 82 off the pipe-line 77 between the vaporization passage-way 76 and the second compressor 38*b*.

In this system the composition of the light or main refrigerating fluid is for instance substantially the same as in the system shown on FIG. 1 whereas the quantitative molar composition of the heavy or auxiliary refrigerating fluid is for instance changed to the following:

methane $CH_4$: 0% to 10%
ethylene $C_2H_4$ or ethane $C_2H_6$: 30% to 70%
propylene $C_3H_6$ or propane $C_3H_8$: 10% to 60%
isobutane or normal butane $C_4H_{10}$ and less volatile hydrocarbons: 0% to 20%

The workings of the circuits 1 and 2 of the gas to be liquefied and of the main refrigerating fluid, respectively, remain unchanged whereas the operation of the cycle 3 of auxiliary refrigerating fluid is changed as follows: the subcooled liquid auxiliary refrigerating fluid, circulating in the pipe-line 50 is divided at the branch point 81 into two partial parallel streams the first one of which flows through the valve 51 to be expanded therein thereby being cooled for instance down to a temperature of about −70° C. and having its absolute pressure lowered for instance to about 3 bars; it then flows through the passage-way 75 to keep vaporizing therein through heat exchange in counter-current relationship with the fluids circulating in the flow passage-ways 19 and 49, respectively, and it issues from the heat exchanger 6 through the duct 56 for instance at a temperature of about +30° C. and at a low pressure for instance of about 2.5 bars. The other partial stream diverted through the pipe-line 80 flows through the valve 79 to be expanded therein whereby its absolute pressure is lowered for instance to about 10 bars; it then flows through the passage-way 76 to keep vaporizing therein through heat exchange in counter-current relationship with the main and auxiliary refrigerating fluids, respectively, circulating in the flow passage-ways 19 and 49, respectively. This other fully vaporized partial stream leaves the passage-way 76 through the duct 77 at a temperature for instance of about +30° C. and at a lower mean or intermediate pressure for instance of about 9 bars corresponding to the delivery pressure of the first compressor 38*a* in the pipe-line 39. At the point 82 it mixes with the gaseous auxiliary refrigerating fluid issuing from the intermediate or inter-stage cooler 40 and then both gaseous fluxes thus combined together are drawn in by the second compressor 38*b*.

Thus in this examplary embodiment the auxiliary refrigerating fluid is vaporized at three different pressures which respectively are the low pressure prevailing at the suction side of the first compressor 38*a*, a first intermediate (so-called mean or lower intermediate) pressure between the first and second compressors 38*a* and 38*b* and a second intermediate (so-called last intermediate or higher intermediate pressure) between the intermediate compressor 38*b* and the last or third compressor 38*c*.

The system shown on FIG. 3 differs from that illustrated by FIG. 2 by the fact that the main refrigerating fluid instead of undergoing one single previous cooling through heat exchange with the auxiliary refrigerating fluid in one single heat exchanger 6 as on FIG. 2 is subjected to two consecutive coolings through successive heat exchangers in two heat exchangers 6*a* and 6*b* where the respective flow passage-ways of the main refrigerating fluid 19*a* and 19*b* are connected in series through an intermediate duct 83 and the downstream end of the flow passage-way 19*b* is connected to the pipe-line 20 leading to the phase separator 21. To the flow passage-way 49 of auxiliary refrigerating fluid in the heat exchanger 6 according to FIG. 2 would here correspond the flow passage-way 49*a* of the first heat exchanger 6*a* whereas after the bifurcation point 81 the pipe-line 50 is connected to the upstream end of the flow passage-way 49*b* located in the second heat exchanger 6*b* and the downstream end of which is connected through the pipe-line 50′ to the inlet of the expansion valve 51. Since the respective vaporizations of the liquid refrigerating fluid expanded in the valves 51 and 79 to two different low and means pressures, respectively, keep taking place in both distinct or separated heat exchangers 6*a* and 6*b* the ducts 52 and 78 for the corresponding partial streams of the expanded auxiliary refrigerating fluid may here be connected to for instance jet-producing spray distributing devices 53*b* and 53*a*, respectively, opening into the inside spaces 54*b* and 54*a*, respectively, of the casings or shells of the heat exchangers 6*b* and 6*a* (although at least one or each one of the ducts 52 and 78 may be connected to a confined vaporization passage-way extending in the respective heat exchangers 6*b* and 6*a*).

The light or main and heavy or auxiliary refrigerating fluids have each one substantially the same qualitative and quantitative relative composition as in the system shown on FIG. 2.

The auxiliary refrigerating fluid leaving in the subcooled liquid state the flow passage-way 49*a* of the heat exchanger 6*a* through the pipe-line 50 is for instance at a temperature of about −10° C. and at an absolute pressure of about 29 bars. The expanded partial stream exiting from the valve 79 through the pipe-line 78 is for instance at a temperature of about −15° C. and at an absolute pressure of about 10 bars; this stream is distributed at 53*a* into the inside space 54*a* of the heat exchanger 6*a* where it keeps vaporizing through heat exchange by means of a direct contact in countercurrent relationship with the respective fluids circulating in the flow passage-ways 19*a* and 49*a* and it issues through the port 55*a* of the shell of this heat exchanger for instance at a temperature of about +30° C. and at a mean or lower intermediate pressure of about 9 bars. The other sub-cooled liquid partial stream of the auxiliary refrigerating fluid coming from the bifurcation point 81 flows through the flow passage-way 49*b* in the heat exchanger 6*b* to be further sub-cooled therein and it leaves this flow passage-way through the duct 50′ for instance at a temperature of about −65° C. and at an absolute pressure of about 28 bars to be expanded in the expansion valve 51 whereby its temperature is lowered for instance to about −70° C. and its absolute pressure is lowered for instance to about 3 bars. This expanded partial stream is then distributed at 53*b* into the inside space 54*b* of the heat exchanger 6*b* where it keeps vaporizing through heat exchange with the fluids circulating in the flow passage-ways 19*b* and 49*b*, respectively, thereby further cooling these fluids; this second partial stream thus vaporized leaves the inside space 54*b* through the discharge port 55*b* in the shell of the heat exchanger 6*b* to circulate in the pipe-line 56 at a temperature for instance of about −15° C. and at a low absolute pressure for instance of about 2.5 bars. It is thus found that the low pressure gaseous auxiliary refrigerating fluid in the pipe-line 56 which is fed to the suction side of the first compressor 38*a* is colder i.e. at a lower temperature (−15° C.) than in the case of the embodiment shown on FIG. 2 (where its temperature is +30° C.).

The embodiment shown on FIG. 4 mainly differs from that shown on FIG. 2 by the addition of a cryogenic precooling heat exchanger 84 for the relatively dry natural gas to be liquefied, which heat exchanger is inserted in the gas supply pipe-line 7 before the cryogenic gas-cooling heat exchanger 5. This gas pre-cooling heat exchanger 84 which is for instance of the plate construction type comprises at least one gas passage-way 85 connected at its upstream end to the pipe-line 7 and at its opposite or downstream end by means of a connecting duct 7′ to the upstream or input end of the passage-way 8 of the cryogenic gas-cooling heat exchanger 5. The heat exchanger 84 moreover contains at least one flow passage-way 86 and a vaporization passage-way 87 for the auxiliary refrigerating fluid extending in at least approximately parallel relation to the direction of the flow passageway 85 and which are connected in series to one another. The flow passage-way 86 has its upstream or input end connected through a duct 88 to an intermediate branch point 89 of the pipe-line 48 located between the flow passage-way 49 and the branch point 57. The opposite or downstream end of the flow passage-way 86 is connected through a pipe-line 90 to the inlet of an expansion member such as a valve or the like 91 the outlet of which is connected through a pipe-line 92 to the upstream or inlet end of the confined vaporization passageway 87 the opposite downstream or outlet end of which is connected through a pipe-line 93 to the suction side of the second compressor 38*b;* at the intermediate points 82 and 94 of this pipe-line 93 are respectively branched the pipe-line 39 at the outlet of the intermediate or inter-stage cooler 40 and the pipe-line 77.

The respective light or main and heavy or auxiliary refrigerating fluids have here for instance substantially the same qualitative and quantitative relative compositions as the corresponding refrigerating fluids of the examplary embodiment shown on FIG. 2 and the circuits 1 and 2 here operate substantially in the same way as the corresponding circuits of FIG. 2 whereas the operation of the circuit 3 is changed as follows.

The gas to be liquefied in the relatively dry state having for instance a temperature of about +20° C. and an absolute pressure of about 45 bars is supplied through the pipeline 7 and flows through the flow passage-way 85 of the pre-cooling heat exchanger 84 where this gas is pre-cooled thereby having its temperature lowered for instance to about −15° C. (for a corresponding pressure for instance of about 44.5 bars) through heat exchange with the auxiliary refrigerating fluid flowing through this same pre-cooling heat exchanger. The gas thus pre-cooled reaches through the pipe-line 7' a cryogenic cooling heat exchanger 5 from which its physical and thermodynamical evolution is the same as that previously described.

One portion of at least in major part liquefied auxiliary refrigerating fluid fed by the pipe-line 48 after the branch point 57 is diverted at the branch point 89 through the pipe-line 88 and flows through the flow passage-way 86 of the pre-cooling heat exchanger 84 where this portion is successively fully liquefied and then sub-cooled through heat exchange with at least one part of itself. This sub-cooled liquid portion leaves the flow passage-way 86 through the pipe-line 90 while being at a temperature for instance of about −15° C. and at an absolute pressure for instance of about 29 bars and then flows through the valve 91 to undergo an expansion therein which cools it down to a temperature for instance of about −20° C. thereby lowering its absolute pressure for instance to about 10 bars. The portion thus expanded of the auxiliary refrigerating fluid issues from the valve 91 through the pipe-line 92 to flow through the confined passage-way 87 where this portion is fully vaporized through heat exchange in counter-current relation to the fluids circulating in the passage-way 85 and in the flow passage-way 86, respectively, thereby resulting on the one hand in the precooling of the natural gas in the passage-way 85 and on the other hand in the full liquefaction and in the sub-cooling of that portion of auxiliary refrigerating fluid which circulates in the flow passage-way 86. The portion thus fully vaporized of auxiliary refrigerating fluid leaves the heat exchanger 84 through the pipe-line 93 while being for instance at a temperature of about +30° C. and at said lower mean or intermediate pressure of 9 bars to thereafter mix at the branch points 94 and 82 with the vaporized portions of auxiliary refrigerating fluid arriving through the pipe-lines 77 and 39, respectively, and then the fluxes thus added of gaseous auxiliary refrigerating fluid are drawn in by the intermediate compressor 38*b*.

The system according to FIG. 4 illustrates a division of the input compression power between the cycle 2 of main refrigerating fluid and the cycle 3 of auxiliary refrigerating fluid and it may advantageous to load one of both cycles more than the other one. In the present case the input compression power is the same in both cycles 2 and 3 but the cycle of the auxiliary refrigerating fluid is for instance more loaded than in the embodiment shown on FIG. 2. By way of illustrative example the system according to FIG. 4 may comprise two prime movers for driving the compressors in each one of the cycles 1 and 2, namely:

a separate prime mover for individually driving the compressor 15*a*, a separate prime mover for individually driving the compressor 15*b*, a separate prime mover for individually driving the compressor 38*a*, a prime mover for driving both compressors 38*b* and 38*c* in common (which then are mechanically coupled operatively through their respective shafts).

The confined vaporization passage-way 87 in the pre-cooling heat exchanger 84 may possibly be replaced by the inside space 95 defined by the shell or casing of the heat exchanger 84 and the pipe-line 92 is then connected to a for instance jet-producing spray distribution device placed in the heat exchanger and opening directly into the inside space 95 so that the auxiliary refrigerating fluid would flow in this inside space in counter-current relation to the fluids carried along in the flow passage-ways 85 and 86, respectively, while streaming thereabout in direct contact therewith.

The system shown on FIG. 5 is derived from that shown on FIG. 3 by the addition to the latter of a cryogenic gas-pre-cooling heat exchanger 84 such as the one shown on FIG. 4 but by possibly replacing the plate-construction heat exchanger of FIG. 4 by a heat exchanger including nests, clusters or bundles of coiled tubing or piping. The expanded auxiliary refrigerating fluid distributed into the inside space 95 by the distributor device 96 then flows in a direction opposite to the common direction of flow of the fluids in the flow passage-ways 85 and 86, respectively, while streaming thereabout in direct contact therewith thus resulting in a heat exchange continuing the vaporization of the fluid together with attendant cooling of the natural gas in the confined passage-way 85 and of the auxiliary refrigerating fluid in the confined flow passage-way 86. The auxiliary refrigerating fluid thus fully vaporized in the inside space 95 leaves the latter through the port 87 provided in the shell of the heat exchanger 84 to be then carried along by the pipe-line 92 as previously described. The relatively dry natural gas is here supplied through the pipe-line 7 at a temperature for instance of about +20° C. and at an absolute pressure for instance of about 46 bars and it is pre-cooled in the heat exchanger 84 down to a temperature for instance of −15° C. under a pressure for instance of about 45 bars.

The circuits 1, 2 and 3 besides operate substantially the same way as in the foregoing examplary embodiments such as previously described.

By way of comparison the numerical data in the following table show the input powers taken by the compressors and pumps of the cycles of main and auxiliary refrigerating fluids, respectively, and the relative gains or savings in input power correlated with the total input power of the compressors of a system according to the prior art.

TABLE

| System involved | Total input compression power, in kW | Gain in total input power with respect to the prior art, in % |
|---|---|---|
| Prior art | 73,250 | — |
| Invention according to FIG. 1 | 68,970 | 5.85 |
| Invention according to FIG. 2 | 66,440 | 9.30 |
| Invention according to FIG. 3 | 65,590 | 10.45 |
| Invention according to FIG. 4 | 65,910 | 10.02 |
| Invention according to FIG. 5 | 65,190 | 11.00 |

The foregoing table shows by way of mere illustrative non-limiting example that the utmost energy saving thus achieved with the system according to the invention such as shown on FIG. 5 reaches 11%.

It should be understood that the invention is not at all limited to the embodiments described and shown which have been given by way of examples only. In particular it comprises all the means constituting technical equivalents of the means described as well as their combinations if same are carried out according to its gist and used within the scope of the appended claims.

What is claimed is:

1. A method of cooling and liquefying at least one relatively dry gas having a low boiling point through heat exchange with at least one part of a light main refrigerating fluid pre-cooled until its at least partial liquefaction through heat exchange with a heavy auxiliary refrigerating fluid, said refrigerating fluids being part of an incorporated cold-generating cascade of at least these two refrigerating fluids, each refrigerating fluid consisting of a mixture of several component substances with decreasing volatilities, respectively, evolving according to a closed-loop cooling cycle while successively undergoing therein: at least one compression in the gaseous state from a low pressure to a higher pressure, at least one preliminary cooling with possible at least partial condensation at said higher pressure through heat exchange with a cooling medium in particular of outer origin, at least one self-refrigeration with total liquefaction and then sub-cooling and thereafter expansion down to said low pressure through subsequent heat exchange (and resulting attendant vaporization) in counter-current relationship with itself before its expansion and to the other refrigerating fluid or with said gas for at least partially liquefying the latter, its low pressure vapor thus reheated being eventually recycled and recompressed, wherein the improvement consists in the steps of reducing, for a same amount of treated products, the required total input power taken by the compressions of at least the refrigerating fluids by carrying out said compression at least of said auxiliary refrigerating fluid adapted to pre-cool said main refrigerating fluid in several successive separate compressions of gradually increasing amounts and at last the total amount of said auxiliary refrigerating fluid to respectively different pressures namely at least one intermediate pressure and at least one high pressure, at least the last but one compression of which is followed by said at least partial condensation and then subjecting several distinct portions of said high pressure auxiliary refrigerating fluid to respective expansions down at least to one intermediate pressure and to said low pressure followed each one by a vaporization of at least the major part at the corresponding expanded pressure; that portion to be expanded to and at least partially vaporized at said low pressure as well possibly as at least one or each other portion to be expanded to and at least partially vaporized at a corresponding intermediate pressure being each one sub-cooled in the liquid state before its consecutive expansion and vaporization through heat exchange in counter-current relationship with at least one part of itself already expanded previously and then vaporized by said heat exchange, each portion thus vaporized in at least its major part being thereafter recycled for being recompressed; the vaporization at the last intermediate pressure being effected in particular through heat exchange with said gas initially in the moist state to cool the latter thereby resulting in its relative drying through at least partial condensation of its moisture content whereas each aforesaid portion expanded and then vaporized at another lower pressure is also in heat exchanging counter-current relationship with said main refrigerating fluid for cooling and/or at least partially condensing same.

2. A method according to claim 1, wherein said auxiliary refrigerating fluid at least partially condensed at said high pressure is successively fully liquefied and then sub-cooled and thereafter expanded down to said low pressure for subsequent heat exchange (with resulting attendant vaporization) in counter-current relationship with itself before its expansion and with said main refrigerating fluid, wherein the improvement consists in the following steps carried out on said auxiliary refrigerating fluid and on said gas:

performing said last but one compression on one portion of said auxiliary refrigerating fluid;

separating the gaseous and liquid phases, respectively, of the total flow rate of auxiliary refrigerating fluid at least partially condensed at said last intermediate pressure;

performing the last compression in two attendant separate compressions of said gaseous and liquid phases, respectively, up to said high pressure;

combining the high pressure gaseous phase and at least the major part of the high pressure liquid phase into a first partial flux in the mixed state;

condensing at least a large part of said first partial flux through heat exchange with a cooling medium in particular of outer origin;

taking one portion from said first partial flux at least one part of which undergoes the total liquefaction, a sub-cooling and an expansion to said low pressure and then said heat exchange (with resulting attendant vaporization) in counter-current relationship with itself before expansion and with said main refrigerating fluid and thereafter recompressing the low pressure vapor to a higher pressure;

performing attendant separate expansions of the other portion of said first partial flux and of the remaining part of said high pressure liquid phase down to said last intermediate pressure;

combining said other expanded vaporized portion and said remaining expanded part of said liquid phase into a second partial flux in the mixed state and then reheating and vaporizing same to a large extent through said heat exchange with said gas;

returning and combining said second partial flux vaporized to a large extent with said first-named portion of said first partial flux at least partially condensed at said last intermediate pressure before said phase separation.

3. A method according to claim 2, wherein at least one part of said first-named portion of said first high pressure partial flux is divided after its total liquefaction and sub-cooling into at least two fractions which are then separately expanded to and vaporized in parallel relationship at said low pressure and at a mean intermediate pressure lower than said last intermediate pressure, said fractions thus expanded being vaporized through heat exchange in counter-current relationship with themselves before expansion and with said main refrigerating fluid whereas said low pressure vapor after having been successively recompressed and preliminarily cooled at said mean pressure is combined with said mean pressure vapor to thus restore said first partial flux which is then recompressed to a higher intermediate pressure.

4. A method according to claim 3, further comprising the step of pre-cooling said relatively dry gas by means of a heat exchange with said auxiliary refrigerating fluid.

5. A method according to claim 4, wherein another part of said first-named portion of said first high pressure partial flux is successively liquefied fully and then sub-cooled and thereafter expanded to and vaporized at said mean pressure, said other part thus expanded being vaporized through heat exchange in counter-current relationship with itself before expansion and with said relatively dry gas for pre-cooling the latter; the mean pressure vapors originating from said corresponding fraction and from said other part, respectively, being then combined with said mean pressure vapor preliminarily cooled and thereafter recompressed together to said higher intermediate pressure.

6. A method according to claim 2, wherein said pre-cooling of said main refrigerating fluid is carried out in two successive stages of increasing cooling and at least one part of said first-named portion of said first partial flux is successively liquefied fully and sub-cooled and thereafter divided into two fractions the first one of which is expanded down to a mean intermediate pressure for subsequent heat exchange (and resulting attendant vaporization) in counter-current relationship with said portion before expansion and with said main refrigerating fluid for cooling the latter in a first stage whereas the second fraction is additionally sub-cooled and then expanded down to said low pressure for subsequent heat exchange (and resulting attendant vaporization) in counter current relationship with itself before expansion and with said main refrigerating fluid already previously pre-cooled for further cooling the latter in a second stage; the vapor at said low pressure being recycled for being recompressed to said mean pressure and then after preliminary cooling through heat exchange with a coolant in particular of outer origin, combined with the mean pressure vapor of said first fraction before being recompressed to said last intermediate pressure.

7. A method according to claim 6 wherein another part of said first-named portion of said first high pressure partial flux is successively liquefied fully and then sub-cooled and thereafter expanded to and vaporized at said mean pressure, said other part thus expanded being vaporized through heat exchange in counter-current relationship with itself before expansion and with said relatively dry gas for pre-cooling the latter, the mean pressure vapors originating from said corresponding fraction and from said other part, respectively, being then combined with said mean pressure vapor preliminarily cooled and then recompressed together to said higher intermediate pressure, said method further comprising the step of combining said mean pressure vapors originating from said first fraction of one part of said firs-named portion of said first partial flux on the one hand with the other part of said portion on the other hand before being recompressed to said last intermediate pressure.

8. A method according to claim 1, wherein said main or light refrigerating fluid has the following molar composition:

nitrogen $N_2$: 0% to 10% methane $CH_4$: 30% to 60% ethylene $C_2H_4$ or ethane $C_2H_6$: 30% to 60% propylene $C_3H_6$, propane $C_3H_8$, butane and less volatile hydrocarbons: 0% to 20%.

9. A method according to claim 1, wherein said auxiliary or heavy refrigerating fluid has the following molar composition:

methane $CH_4$: 0% to 10% or to 15% ethylene $C_2H_4$ to ethane $C_2H_6$: 30% to 65% or to 70% propylene $C_3H_6$ or propane $C_3H_8$: 10% to 60% isobutane or normal butane $C_4H_{10}$ and less volatile hydrocarbons: 0% to 20% or to 30%.

10. An apparatus for cooling and liquefying at least one relatively dry gas having a low boiling point, including at least the following circuits: on the one hand, an in particular open circuit of gas to be liquefied; on the other hand, a closed circuit of main refrigerating fluid in heat exchanging relationship with said gas circuit by means of cryogenic heat exchangers for liquefying, sub-cooling and pre-cooling purposes respectively, and being part of one cold-generating incorporated cascade of at least two refrigerating main and auxiliary fluids, respectively; and at last a closed circuit of auxiliary refrigerating fluid in heat exchanging relationship with said circuit of main refrigerating fluid by means of at least one cryogenic heat exchanger for pre-cooling and at least partially liquefying said main refrigerating fluid and comprising at least the following elements: at least one gaseous fluid compressor, a condensing cooler operating with a coolant in particular of outer origin, a total liquefaction and sub-cooling flow passage-way extending through said pre-cooling heat exchanger and extending generally in the same direction as the flow passage-way for the main refrigerating fluid therein, a first expansion member at the downstream end of said total liquefaction and sub-cooling flow passage-way and connected to a vaporization passage-way extending through said pre-cooling heat exchanger to lead to the low pressure suction side of said compressor, wherein the improvement consists in that the outlet of said condensing cooler is connected to the inlet of a phase separator the vapor collecting space of which is connected to the suction side of another compressor the delivery side of which is connected to the inlet of another condensing cooler operating with a cooling medium in particular of outer origin, whereas the liquid collecting space is connected to the suction side of an accelerating pump the delivery side of which is connected in part to the inlet of said other condensing cooler and in part to a second expansion member; the outlet of said other condensing cooler being connected on the one hand to the inlet of said total liquefaction and sub-cooling flow passage-way and on the other hand to a third expansion member; the outlets of said second and third expansion members being connected to the inlet of said phase separator through a cooler for said gas to be liquefied which is initially in a relatively moist state.

11. An apparatus according to claim 10 having said circuit of auxiliary refrigerating fluid which comprises two compressors connected in series through an intermediate cooler operating with a coolant in particular of outer origin, the suction side of said first compressor being connected to said vaporization passage-way and the delivery side of said second compressor being connected to the inlet of said first-named condensing cooler, wherein the improvement consists in that the downstream end of said total liquefaction and sub-cooling flow passage-way is also connected in parallel relationship through another expansion member to another vaporization passage-way also extending through said pre-cooling heat exchanger, the respective downstream ends of both vaporization passage-ways being connected to the suction sides of both aforesaid compressors, respectively.

12. An apparatus according to claim 11, further comprising a heat exchanger for pre-cooling said relatively dry gas to be liquefied and through which respectively extend one flow passage-way for said gas, one flow passage-way for total liquefaction and sub-cooling of said auxiliary refrigerating fluid, the upstream end of which is branched off the duct connecting the outlet of said other condensing cooler to the inlet of said pre-cooling heat exchanger for said main refrigerating fluid whereas its downstream end is connected to the inlet of a fourth expansion member, as well as a vaporization passage-way connected at its upstream side to the outlet of said fourth expansion member and at its downstream side to the suction side of said second compressor.

13. An apparatus according to claim 10, wherein said pre-cooling heat exchanger consists of two heat exchangers through which respectively extend two flow passage-ways for at least partial liquefaction of said main refrigerating fluid which are connected in series and said two vaporization passage-ways for said auxiliary refrigerating fluid, the vaporization passage-way of said downstream heat exchanger being connected at its downstream end to the suction side of said first compressor and at its upstream end successively through the associated expansion member and an additional sub-cooling flow passage-way to the downstream end of the flow passage-way for total liquefaction and sub-cooling of the auxiliary refrigerating fluid in said upstream heat exchanger whereas the vaporization passage-way in the latter in connected to the suction side of said second compressor.

* * * * *

UNITED STATES PATENT AND TRADEMARK OFFICE

CERTIFICATE OF CORRECTION

PATENT NO. : 4,339,253

DATED : July 13, 1982

INVENTOR(S) : Enzo Caetani and Henri Paradowski

It is certified that error appears in the above—identified patent and that said Letters Patent is hereby corrected as shown below:

Column 11, line 47, "is" should read --this--.

Column 15, line 64, "means" should read --mean--.

Column 18, line 62, "92" should read --93--.

Column 24, line 30, "in" should read --is--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*